US010865511B2

(12) United States Patent
Bensel et al.

(10) Patent No.: US 10,865,511 B2
(45) Date of Patent: Dec. 15, 2020

(54) NOZZLE ASSEMBLY FOR A WASHING MACHINE APPLIANCE

(71) Applicant: Haier US Appliance Solutions, Inc., Wilmington, DE (US)

(72) Inventors: Peter Hans Bensel, Louisville, KY (US); Troy Marshall Wright, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 432 days.

(21) Appl. No.: 15/813,237

(22) Filed: Nov. 15, 2017

(65) Prior Publication Data

US 2019/0145042 A1 May 16, 2019

(51) Int. Cl.

| | |
|---|---|
| ***D06F 33/00*** | (2020.01) |
| ***D06F 39/08*** | (2006.01) |
| ***D06F 39/12*** | (2006.01) |
| ***G08C 17/00*** | (2006.01) |

(52) U.S. Cl.

CPC ..... *D06F 39/088* (2013.01); *D06F 33/00* (2013.01); *D06F 39/12* (2013.01); *G08C 17/00* (2013.01); *D06F 2204/08* (2013.01)

(58) Field of Classification Search

CPC ..... D06F 33/00; D06F 39/088; D06F 39/12; D06F 2204/08; D06F 2210/00; G08C 17/00

USPC ..... 68/12.19, 17 R

See application file for complete search history.

(56) References Cited

U.S. PATENT DOCUMENTS

| | | | |
|---|---|---|---|
| 8,118,240 | B2 | 2/2012 | Rodenbeck et al. |
| 8,739,815 | B2 | 6/2014 | Harrington et al. |
| 9,175,458 | B2 | 11/2015 | Meehan et al. |
| 9,228,329 | B2 | 1/2016 | Rodenbeck et al. |
| 2012/0145249 | A1* | 6/2012 | Rodenbeck ..... E03O 1/057 137/1 |
| 2016/0138207 | A1 | 5/2016 | Del Pos et al. |

* cited by examiner

*Primary Examiner* — Levon J Shahinian

(74) *Attorney, Agent, or Firm* — Dority & Manning, P.A.

(57) ABSTRACT

A washing machine appliance and nozzle assembly is provided herein. The washing machine appliance may include a cabinet, a tub positioned within the cabinet, a wash basket, and a controller. The wash basket may be rotatably mounted within the tub. The wash basket may define a wash chamber for receiving articles for washing. The nozzle assembly may be mounted within the cabinet and configured to provide wash fluid to the tub. The nozzle assembly may include a nozzle housing and an extendable nozzle. The nozzle housing may define a receiving chamber within the cabinet. The extendable nozzle may be movable between a retracted position within the receiving chamber and an extended position outside of the receiving chamber.

16 Claims, 10 Drawing Sheets

NOZZLE ASSEMBLY FOR A WASHING MACHINE APPLIANCE

FIELD OF THE INVENTION

The present subject matter relates generally to washing machine appliances and more particularly to nozzle assemblies for washing machine appliances.

BACKGROUND OF THE INVENTION

Washing machine appliances generally include a tub for containing water or wash fluid (e.g., water and detergent, bleach, or other wash additives). A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc.

During operation of certain washing machine appliances, a volume of wash fluid is directed into the tub in order to wash or rinse articles within the wash chamber. More specifically, a predetermined volume of wash fluid is typically provided through a stationary nozzle positioned at the center of the back wall of the washing machine appliance. However, in certain situations, a user may wish to have greater control over the wash fluid dispensed into the tub. Moreover, a user may wish to direct the flow of wash fluid onto a particular garment or within a specific region of the wash tub (e.g., to perform a pretreating operation, to saturate a particular article of clothing). However, this ability may be limited by the increased complexity and wiring required to relocate existing stationary nozzles. The ability to adjust the amount of water or wash fluid and its dispensing location is a commercially desirable feature and increases the user's positive perception of the wash process generally.

Accordingly, a washing machine appliance that provides a user with more control over the dispensing of wash fluid is desirable. In particular, a nozzle assembly that enables the dispensing of an additional amount of wash fluid at a desired location within the tub would be particularly beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a washing machine appliance is provided. The washing machine appliance may include a cabinet, a tub positioned within the cabinet, a wash basket, a nozzle assembly, and a controller. The wash basket may be rotatably mounted within the tub. The wash basket may define a wash chamber for receiving articles for washing. The nozzle assembly may be mounted within the cabinet and configured to provide wash fluid to the tub. The nozzle assembly may include a nozzle housing defining a receiving chamber within the cabinet, an extendable nozzle movable between a retracted position within the receiving chamber and an extended position outside of the receiving chamber, and a wireless communications module mounted to the extendable nozzle. The controller may be attached to the cabinet and wirelessly coupled to the nozzle assembly.

In another exemplary aspect of the present disclosure, a washing machine appliance is provided. The washing machine appliance may include a cabinet, a tub positioned within the cabinet, a wash basket, a nozzle assembly, and a controller. The wash basket may be rotatably mounted within the tub. The wash basket may define a wash chamber for receiving articles for washing. The nozzle assembly may be mounted within the cabinet and configured to provide wash fluid to the tub. The nozzle assembly may include a nozzle housing defining a receiving chamber within the cabinet, an extendable nozzle movable between a retracted position within the receiving chamber and an extended position outside of the receiving chamber, an extendable nozzle movable between a retracted position within the receiving chamber and an extended position outside of the receiving chamber, and a positioning switch mounted to the nozzle housing. The positioning switch may be engaged with the extendable nozzle in the retracted position and disengaged with the extendable nozzle in the extended position. The controller may be attached to the cabinet and operably coupled to the nozzle assembly.

In still another exemplary aspect of the present disclosure, a nozzle assembly for a washing machine appliance is provided. The nozzle assembly may include an extendable nozzle, a user input, a nozzle batter, a battery charger, and a valve assembly. The extendable nozzle may be movable between a retracted position and an extended position. The user input may be configured to selectively initiate a flow of wash fluid to the tub. The nozzle battery may be mounted to the extendable nozzle to provide a direct electrical current thereto. The battery charger may be operably coupled to the nozzle battery to selectively recharge the nozzle battery. The valve assembly may be wirelessly coupled to the user input. The valve assembly may be in fluid communication with the extendable nozzle and configured to provide the flow of wash fluid to the extendable nozzle.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
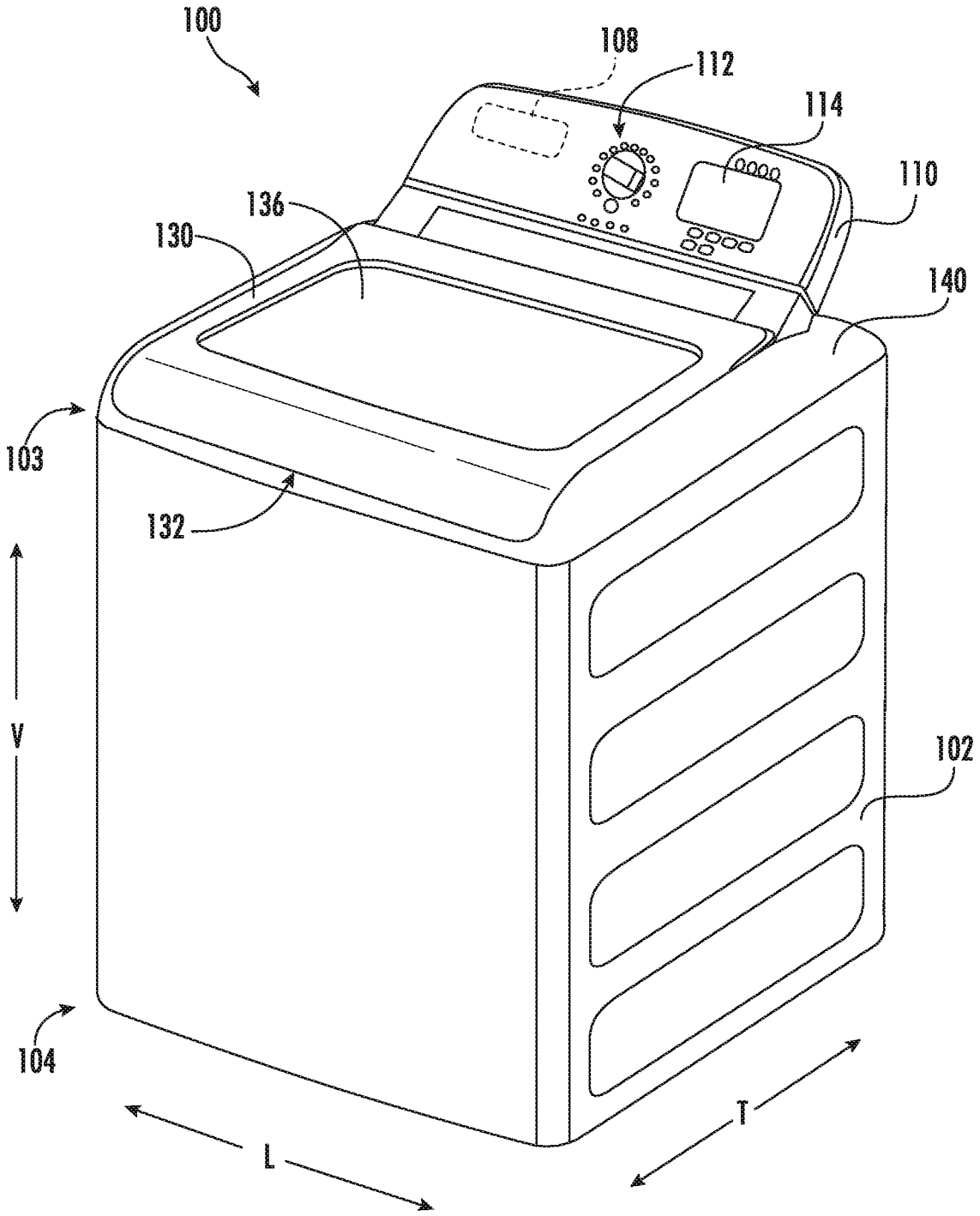
FIG. 1 provides a perspective view of a washing machine appliance according to an exemplary embodiment of the present disclosure with a door of the exemplary washing machine appliance shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In order to aid understanding of this disclosure, several terms are defined below. The defined terms are understood to have meanings commonly recognized by persons of ordinary skill in the arts relevant to the present invention. The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one component from another and are not intended to signify location or importance of the individual components.

Figure 2:
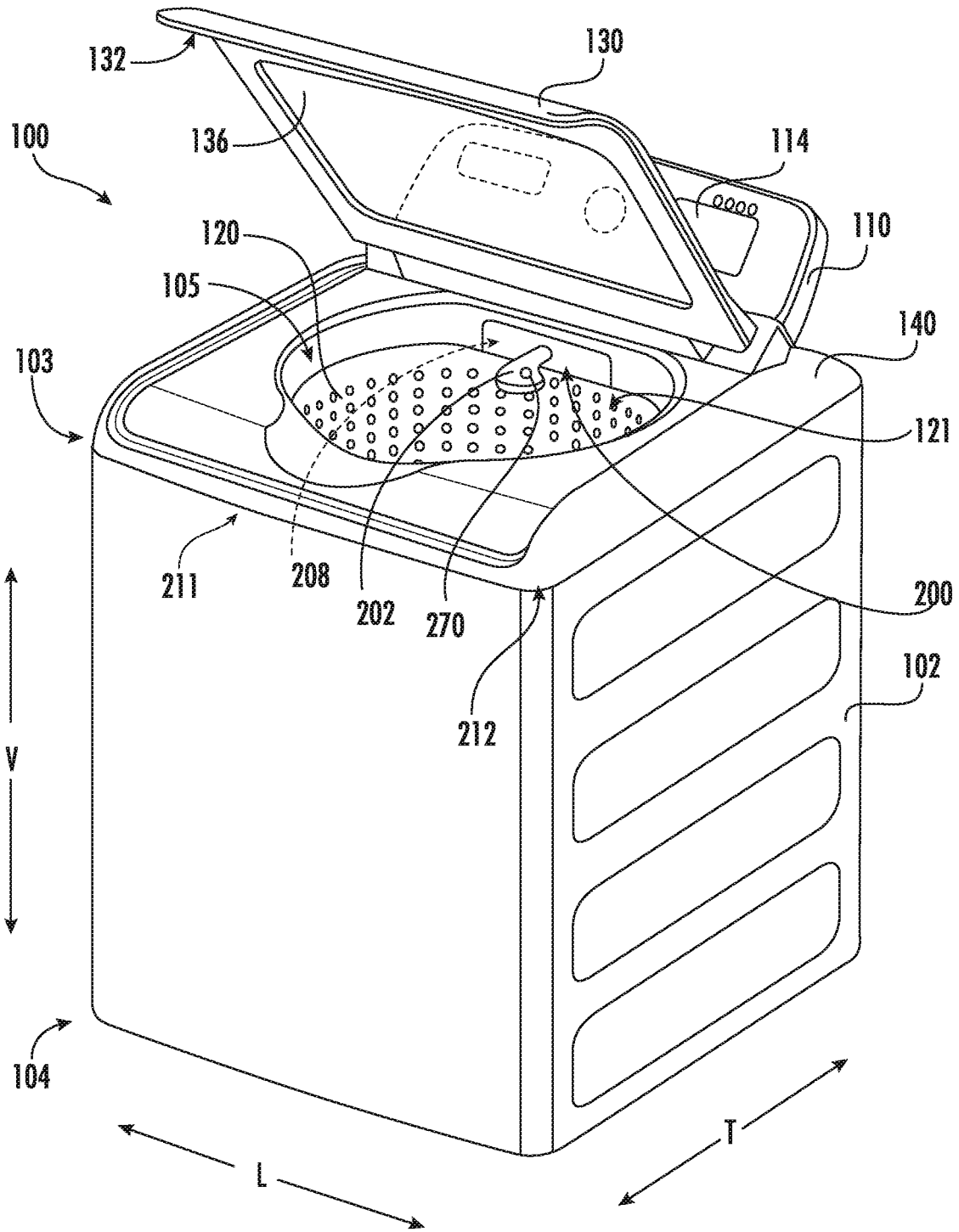
FIG. 2 provides a perspective view of the exemplary washing machine appliance of FIG. 1 with the door of the exemplary washing machine appliance shown in an open position.

Turning now to the figures, FIGS. 1 and 2 illustrate an exemplary washing machine appliance 100. In particular appliance 100 is shown as a vertical axis washing machine. In FIG. 1, a lid or door 130 is shown in a closed position. In FIG. 2, door 130 is shown in an open position. Washing machine appliance 100 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 100, using the teachings disclosed herein it will be understood that washing machine appliance 100 is provided by way of example only. Other washing machine appliances having different configurations, different appearances, or different features may also be utilized with the present subject matter as well (e.g., horizontal axis washing machines). Moreover, aspects of the present subject matter may be used in any other consumer or commercial appliance where it is desirable to control the dispensing of water or another fluid.

As shown, washing machine appliance 100 has a cabinet 102 that extends between a top portion 103 and a bottom portion 104 along the vertical direction V. A wash basket 120 is rotatably mounted within cabinet 102. A motor (not shown) is in mechanical communication with wash basket 120 to selectively rotate wash basket 120 (e.g., during an agitation cycle or a rinse cycle of washing machine appliance 100). Wash basket 120 is received within a wash tub or wash chamber 121 and is configured for receipt of articles for washing. The wash tub 121 holds wash and rinse fluids for agitation in wash basket 120 within wash tub 121. An agitator or impeller (not shown) extends into wash basket 120 and is also in mechanical communication with the motor. The impeller generally assists agitation of articles disposed within wash basket 120 and may rotate or oscillate during operation of washing machine appliance 100.

Cabinet 102 of washing machine appliance 100 generally includes a top panel 140. Top panel 140 defines an opening 105 (FIG. 2) that permits user access to wash basket 120 of wash tub 121. In some embodiments, door 130 is rotatably mounted to top panel 140 and permits selective access to opening 105. In particular, door 130 selectively rotates between the closed position shown in FIG. 1 and the open position shown in FIG. 2. In the closed position, door 130 inhibits access to wash basket 120. Conversely, in the open position, a user can access wash basket 120. In some embodiments, a window 136 in door 130 permits viewing of wash basket 120 when door 130 is in the closed position (e.g., during operation of washing machine appliance 100). Door 130 may also include a handle 132 that, for example, a user may pull or lift when opening and closing door 130. Further, although door 130 is illustrated as mounted to top panel 140, alternatively, door 130 may be mounted to another portion of cabinet 102, as well as any other suitable support.

In certain embodiments, a control panel 110 with at least one input selector 112 extends from top panel 140. Control panel 110 and input selector 112 collectively form a user interface input for operator selection of machine cycles and features. A display 114 of control panel 110 indicates selected features, operation mode, a countdown timer, or other items of interest to appliance users regarding operation.

Operation of washing machine appliance 100 is generally controlled by a controller or processing device 108 that is attached to cabinet (e.g., at control panel 110) and operatively coupled (e.g., electrically coupled via one or more conductive signal lines, wirelessly coupled via one or more wireless communications bands, etc.) to portions of control panel 110 for user manipulation to select washing machine cycles and features. In response to user manipulation of control panel 110, controller 108 operates the various components of washing machine appliance 100 to execute selected machine cycles and features.

Controller 108 may include a memory (e.g., non-transitive storage media) and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 108 may be constructed without using a microprocessor, e.g., using a combination of discrete analog or digital logic circuitry (such as switches, amplifiers, integrators, comparators, flip-flops, AND gates, and the like) to perform control functionality instead of relying upon software. Control panel 110 and other components of washing machine appliance 100 may be in communication with controller 108 via one or more signal lines or shared communication busses.

During operation of washing machine appliance 100, laundry items are generally loaded into wash basket 120 through opening 105, and a washing operation is initiated through operator manipulation of input selectors 112. Wash basket 120 is filled with a fluid, such as water and detergent or other fluid additives (e.g., via a nozzle assembly 200—described in detail below). One or more valves can be controlled by washing machine appliance 100 to provide for filling wash basket 120 to the appropriate level for the amount of articles being washed or rinsed. By way of example, for a washing cycle, once wash basket 120 is properly filled with fluid, the contents of wash basket 120 can be agitated (e.g., with an impeller as discussed previously) for washing of laundry items in wash basket 120.

After the agitation phase of the wash cycle is completed, wash basket 120 can be drained. Laundry articles can then be rinsed by again adding fluid to wash basket 120 depending on the specifics of the cleaning cycle selected by a user. The impeller may again provide agitation within wash basket 120. One or more spin cycles also may be used. In particular, a spin cycle may be applied after the wash cycle or after the rinse cycle to wring wash fluid from the articles being washed. During a spin cycle, wash basket 120 is rotated at relatively high speeds. After articles disposed in wash basket 120 are cleaned or washed, the user can remove the articles from wash basket 120 (e.g., by reaching into wash basket 120 through opening 105).

Referring now generally to FIGS. 2 through 7, nozzle assembly 200 will be described in more detail according to various exemplary embodiments of the present disclosure. Although the discussion below refers to nozzle assembly 200, one skilled in the art will appreciate that the features and configurations described may be used for other fluid supply assemblies in other washing machine appliances as well. For example, nozzle assembly 200 may be positioned in another location within cabinet 102, may have a different fluid supply conduit configuration, or may dispense any suitable wash fluid or fluids (e.g., water, detergent, other additives, or mixtures thereof. Other variations and modifications of the exemplary embodiments described below are possible, and such variations are contemplated as within the scope of the present disclosure.

As illustrated, nozzle assembly 200 generally includes an extendable nozzle 202 mounted to a retractable fluid supply conduit 204. More specifically, retractable fluid supply conduit 204 provides fluid communication between extendable nozzle 202 and a valve assembly 206. In addition, valve assembly 206 is coupled to a supply of water or wash fluid and selectively provides a flow of wash fluid to extendable nozzle 202 so that a user may selectively dispense the wash fluid within wash tub 121. For example, according to the illustrated exemplary embodiments of FIGS. 3 and 4, valve assembly 206 (and thus extendable nozzle 202) is directly coupled to a primary hot and cold water supply 207. In some such embodiments, retractable fluid supply conduit 204 is movable for positioning extendable nozzle 202 in a retracted position and an extended position, as described in more detail below. In this manner, extendable nozzle 202 may function as a primary fill nozzle in the retracted position and a spot treatment wand in the extended position.

Nozzle assembly 200 and its various components may be stored or mounted within cabinet 102 of washing machine appliance 100. For example, nozzle assembly 200 may be mounted directly under top panel 140 along the vertical direction V such that it is positioned between wash tub 121 and top panel 140. In this regard, for example, washing machine appliance 100 may include a nozzle housing 208 defining a receiving chamber 209 within which fluid supply conduit 204 or extendable nozzle 202 are at least partially positioned. For example, when extendable nozzle 202 is in the retracted position, extendable nozzle 202 is positioned within receiving chamber 209. In some such embodiments, extendable nozzle 202 may be visible to the user in the retracted position. However, when extendable nozzle 202 is pulled out toward the extended position, extendable nozzle 202 and at least a portion of fluid supply conduit 204 are positioned outside the receiving chamber 209 of nozzle housing 208 (e.g., above wash tub 121 along the vertical direction V). Notably, maintaining the position of extendable nozzle 202 above the wash tub 121 ensures that wash fluid from within the wash tub 121 cannot be drawn back through extendable nozzle 202 (e.g., into the water supply or leaked elsewhere within washing machine appliance 100).

Although the positioning and movement of nozzle assembly 200 is described herein according to exemplary embodiments, it should be appreciated that variations and modifications to the operation of nozzle assembly 200 may be made while remaining within the scope of the present disclosure. For example, FIG. 2 illustrates nozzle housing 208 and extendable nozzle 202 as being positioned along a back wall 210 and at a center of cabinet 102 along the transverse direction T. By contrast, according to the exemplary embodiments of FIGS. 6 and 7, nozzle housing 208 and extendable nozzle 202 are illustrated as being positioned along a front wall 211 of cabinet 102 at a corner 212 or lateral side along the lateral direction L. However, either embodiment may be positioned at any other suitable location or locations within washing machine appliance 100.

Figure 3:
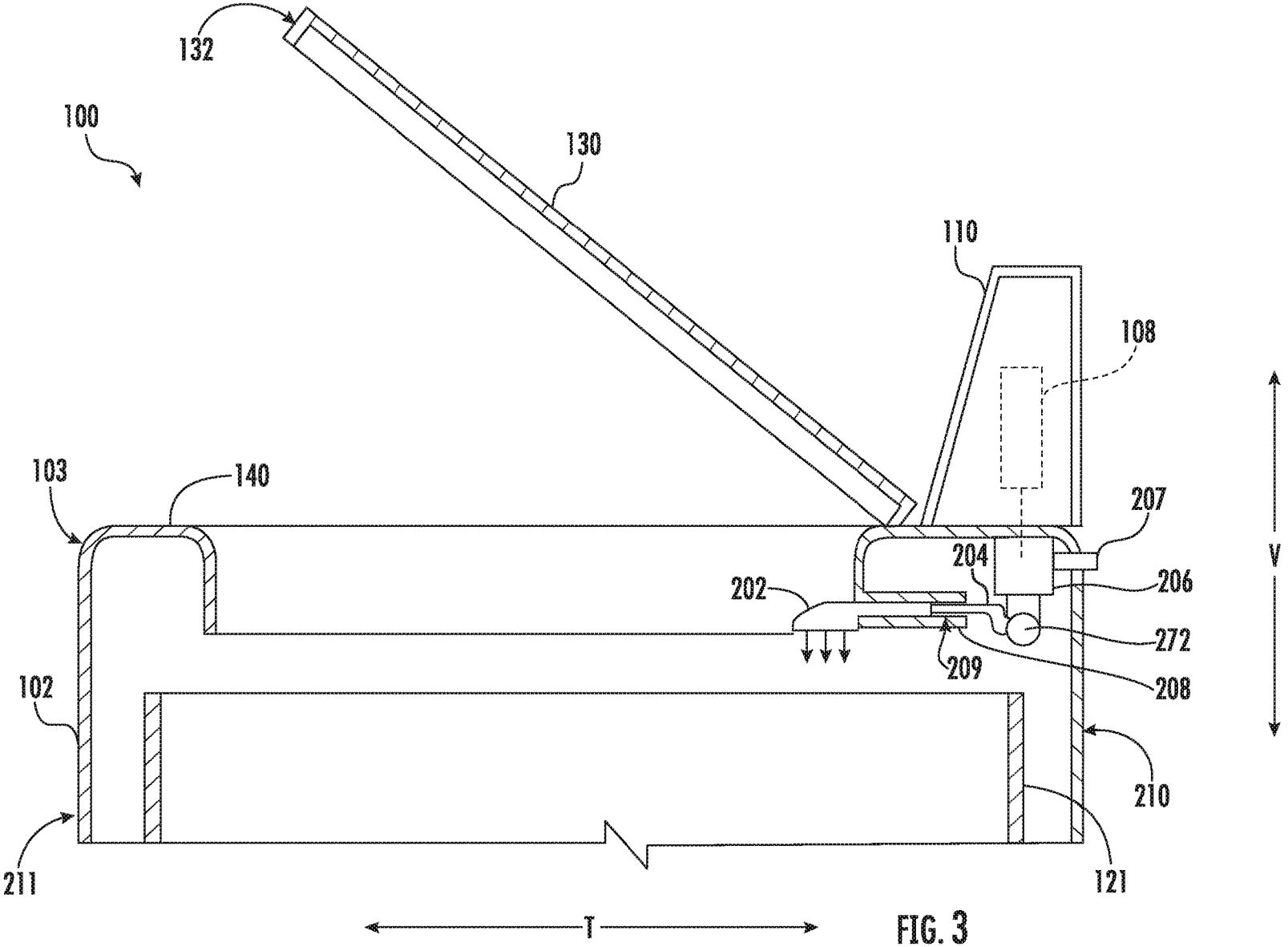
FIG. 3 provides a schematic side, cross-sectional view of a nozzle assembly of the exemplary washing machine appliance of FIG. 1 shown in a retracted position according to an exemplary embodiment of the present disclosure.
Figure 4:
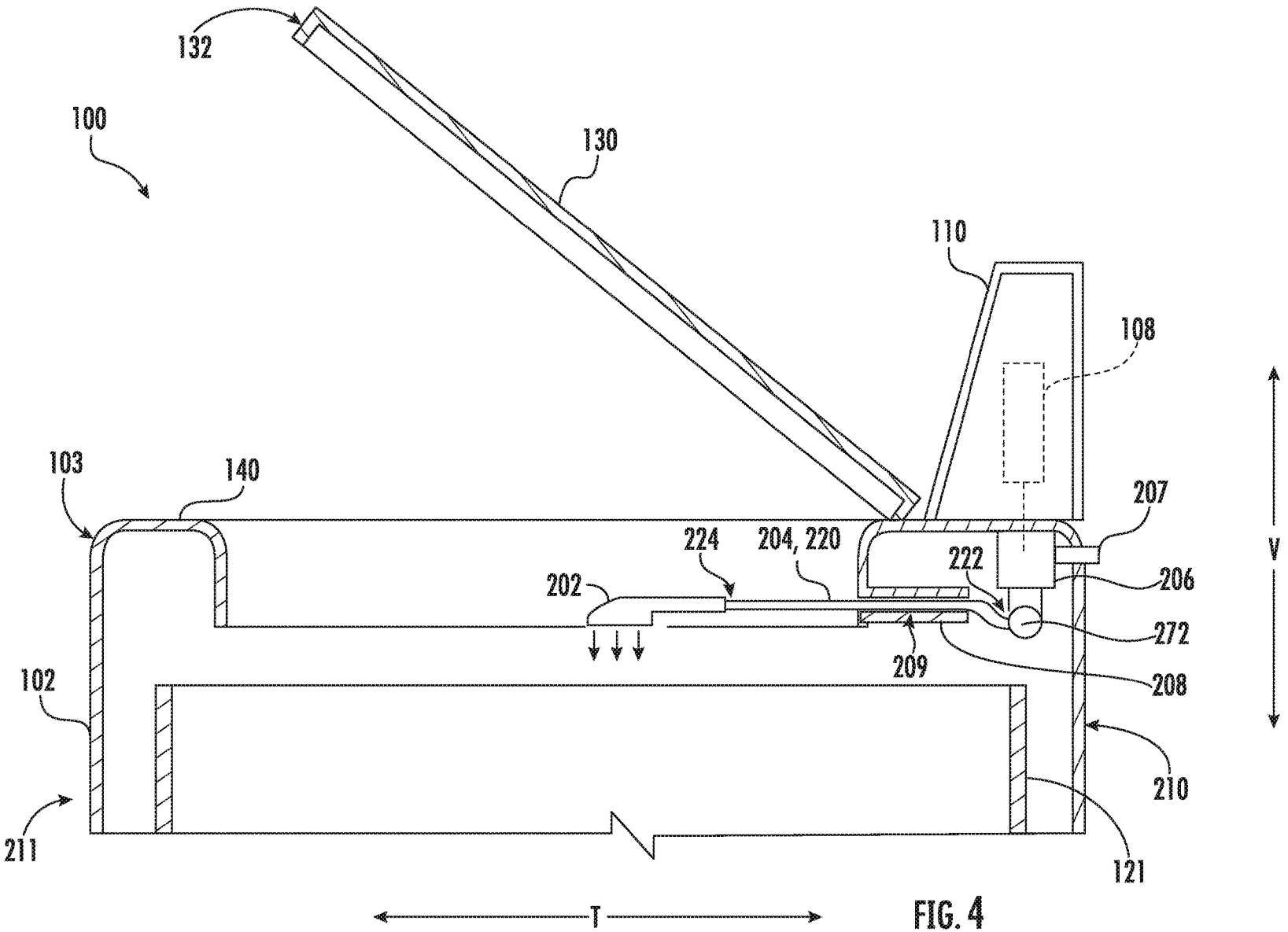
FIG. 4 provides a schematic side, cross-sectional view of the exemplary nozzle assembly of FIG. 3 shown in an extended position.
Figure 5:
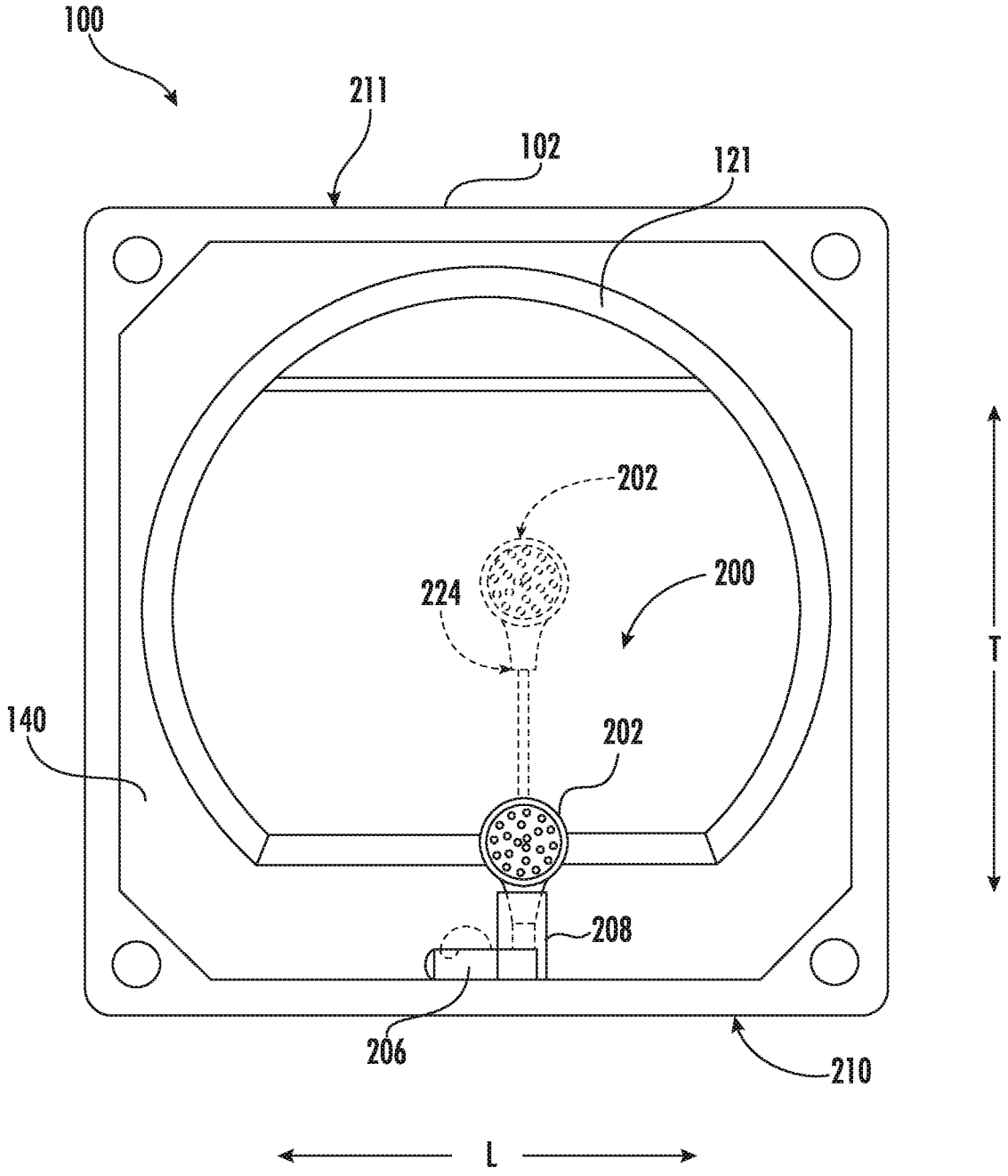
FIG. 5 provides a schematic view of the exemplary nozzle assembly of FIG. 3 shown in both the extended position (in phantom) and the retracted position.

Referring now specifically to FIGS. 3 through 5, retractable fluid supply conduit 204 includes a flexible hose 220 having a first end 222 fluidly coupled to valve assembly 206 and a second end 224 fluidly coupled to extendable nozzle 202. Flexible hose 220 may be any size sufficient to provide wash fluid at the desired flow rate and may be any length suitable for providing a user with flexibility in directing wash fluid to desired portions of wash tub 121 (or otherwise performing a pretreating operation for articles in or near wash tub 121). For example, flexible hose 220 may extend along the entire depth of washing machine appliance 100 along the transverse direction T. Alternatively, according to the illustrated embodiments, flexible hose 220 may only extend about half way into wash tub 121 within a vertical plane when in the extended position (see FIGS. 4 and 5). In this manner, the likelihood of extendable nozzle 202 spraying wash fluid outside of wash tub 121 is reduced. Optionally, one or more retraction mechanisms (not pictured), such as a weighted loop on (e.g., directly or indirectly on) flexible tube or a mechanical spring that extends from nozzle housing 208 to extendable nozzle 202, may be provided to urge or bias extendable nozzle 202 toward the retracted position (see FIG. 3).

Figure 6:
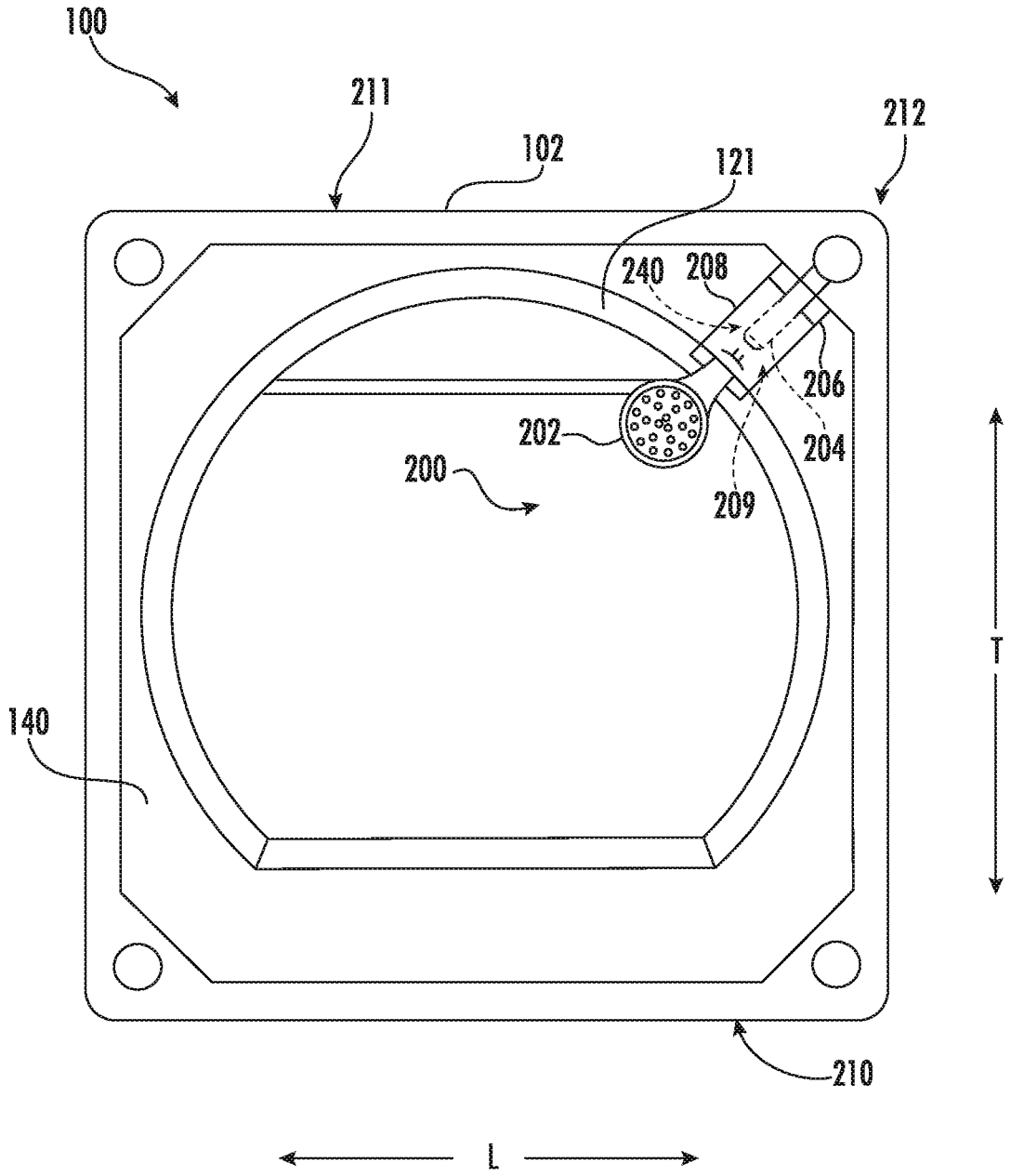
FIG. 6 provides a schematic view of a nozzle assembly of the exemplary washing machine appliance of FIG. 1 shown in a retracted position according to another exemplary embodiment of the present disclosure.
Figure 7:
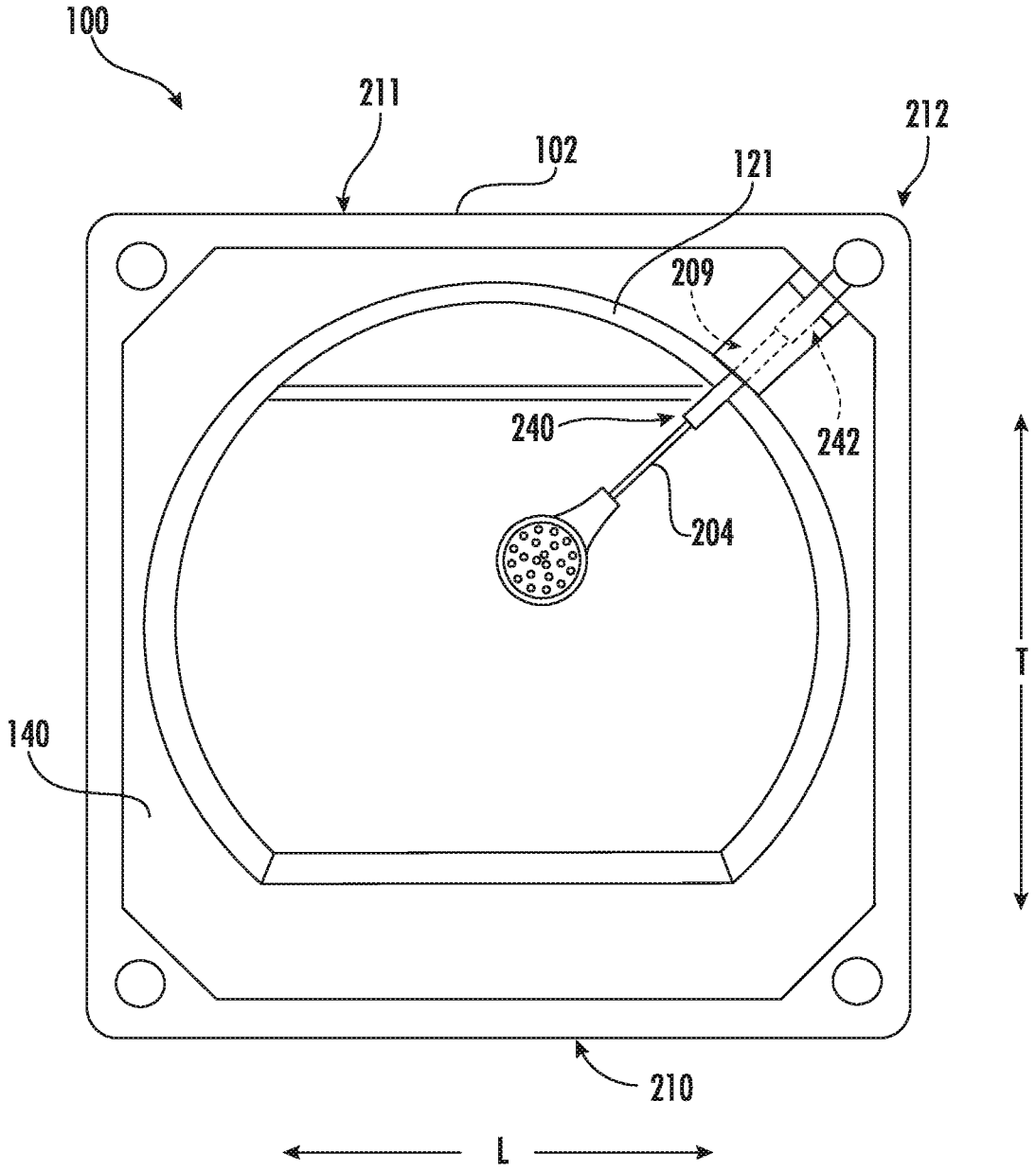
FIG. 7 provides a schematic view of the exemplary nozzle assembly of FIG. 6 shown in an extended position.

Referring now to FIGS. 6 and 7, according to an alternative embodiment of the present subject matter, retractable fluid supply conduit 204 is a telescoping arm 240. As illustrated, telescoping arm 240 includes two or more telescoping sections 242 that are concentric to each other and may slide relative to each other as extendable nozzle 202 is moved between the extended position (see FIG. 7) and the retracted position (see FIG. 6). According to the illustrated embodiment, telescoping sections 242 of telescoping arm 240 actually function as the fluid conduit for providing a flow of wash fluid to extendable nozzle 202. However, it should be appreciated that according to alternative embodiments, a flexible tube or conduit may be positioned within and supported by telescoping arm 240.

In some embodiments, telescoping sections 242 engage each other such that telescoping arm 240 and extendable nozzle 202 extends only in a single vertical plane above wash tub 121. In this manner, the risk of dropping extendable nozzle 202 into wash tub 121 may be reduced or eliminated. In addition, a user may move extendable nozzle 202 to the extended position and then be free to use two hands underneath extendable nozzle 202 (e.g., to, scrub, work, or clean an article of clothing). In order to further facilitate easy cleaning of articles of clothing, according to exemplary embodiments, extendable nozzle 202 may include one or more lights, such as light emitting diodes (LEDs), positioned on (e.g., directly or indirectly on) extendable nozzle 202 and being configured for illuminating when extendable nozzle 202 is moved toward the extended position.

According to the illustrated embodiments of FIGS. 6 and 7, telescoping arm 240 includes three sections 242 and extends from a corner 212 of cabinet 102. In this manner, more space is provided to accommodate telescoping arm 240 and nozzle assembly 200 between wash tub 121 and cabinet 102. It should be appreciated that the size, position, number and size of sections 242, and general configuration of telescoping arm 240 may vary according to alternative embodiments. For example, telescoping arm 240 could extend from the back center of cabinet 102. Alternatively, retractable fluid supply conduit 204 could be a fixed length arm that is connected in back corner 212 of cabinet 102 and pivots (e.g., pivots 45 degrees between a first position where extendable nozzle 202 is positioned at a back center of cabinet 102 to a second position where extendable nozzle 202 is positioned over a center of wash tub 121) within a vertical plane. Moreover, other configurations are possible and within the scope of the present disclosure.

Figure 8:
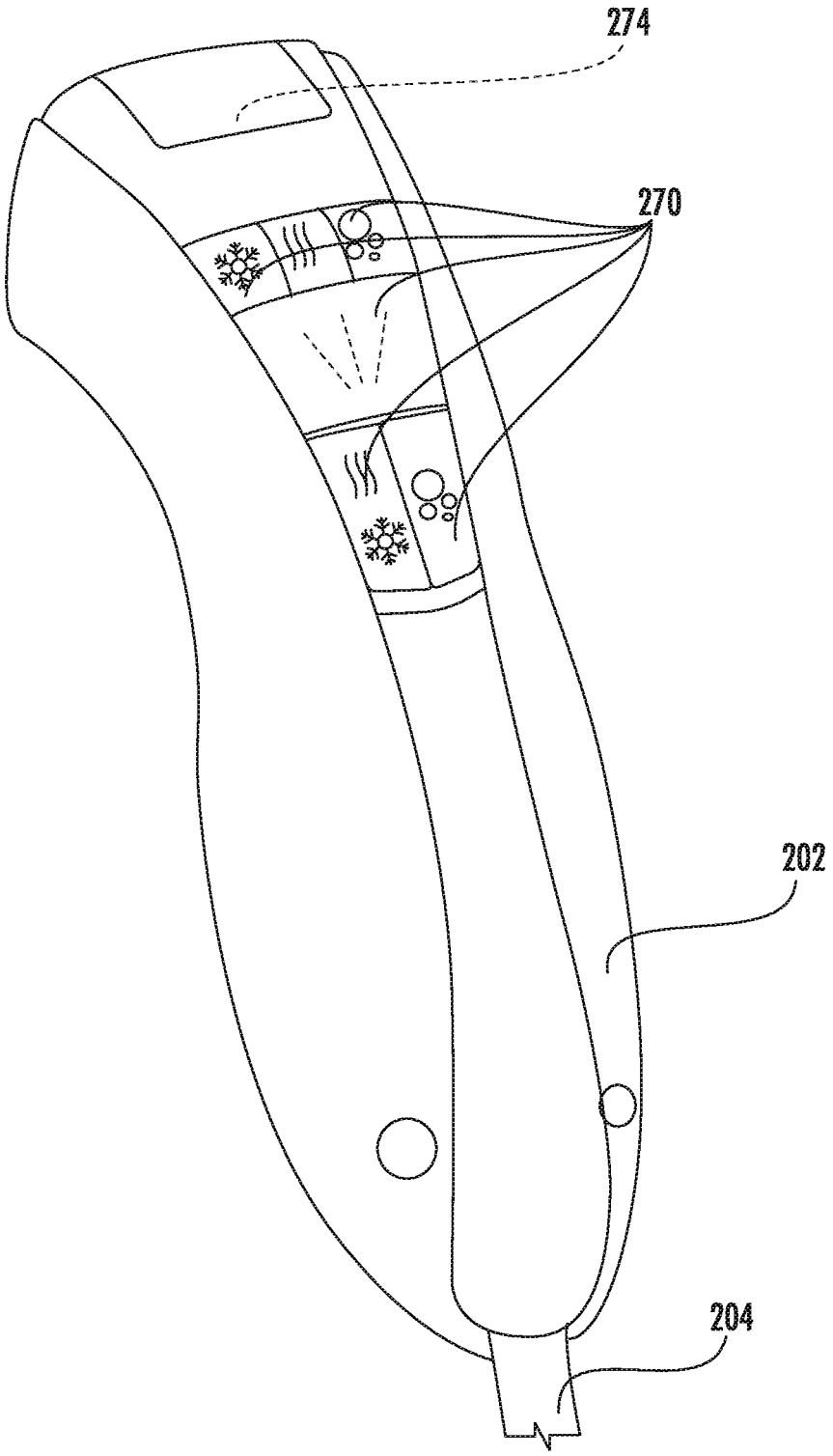
FIG. 8 provides a perspective view of an extendable nozzle according to exemplary embodiments of the present disclosure.

Turning now to FIG. 8, a perspective view of an exemplary extendable nozzle 202 is illustrated. As shown, one or more user inputs 270 (e.g., buttons) may be provided on (e.g., directly or indirectly on) extendable nozzle 202, for instance, to provide a user with control over the flow of wash fluid being dispensed through extendable nozzle 202. In some such embodiments, multiple user inputs 270 may be provided for various unique operations. In some situations, a user may wish to add a volume of water to wash tub 121 (FIGS. 3 and 4) or add a particular wash fluid for a pretreat operation. For example, a user may wish to prewash one or more articles of clothing or may perceive that more water is needed to effectively wash a load. User inputs 270 may be operably coupled (e.g., wirelessly coupled) with controller 108 or valve assembly 206 (e.g., through controller 108 or independent thereof) for controlling the flow of wash fluid. According to the illustrated embodiment, user inputs 270 are located directly on extendable nozzle 202 for easy access by a user or operator. However, according to alternative embodiments, user inputs 270 may be positioned at any other suitable location or locations.

A user input 270 may be any button or switch suitable for providing an indication to controller 108 that a particular action should be initiated. For example, user inputs 270 may be push button switches, toggle switches, rocker switches, rotary switch, rotary encoder, or any other suitable tactile switch, such as capacitive touch buttons. According to the illustrated embodiments, user inputs 270 are momentary switches (sometimes referred to as mom-off-mom switches). In this regard, user inputs 270 are biased switches that return to their unlatched or unpressed state when released (e.g., by spring force).

Referring again to FIGS. 3 and 4, valve assembly 206 generally includes a plurality of valves 272 configured to supply, for example, hot water, cold water, warm water, a mixture of water and wash fluid or detergent, other wash additives, etc. According to an exemplary embodiment, user inputs 270 (FIG. 8) are configured for controlling one or more of valves 272 that can be turned on/off independently or together in any combination. Valves 272 may be, for example, solenoid valves that are operatively coupled (e.g., electrically coupled or wirelessly coupled) to controller 108. However, any other suitable water valve may be used to control the flow of water or wash fluid. Controller 108 may selectively open and close water valves 272 to allow water or wash fluid to flow from hot water inlet, cold water inlet, detergent inlet, softener inlet, or any other suitable fluid through a respective valve seat. Valve assembly 206 or nozzle housing 208 may further include one or more detergent storage compartments, mixing chambers, or other features within which a fluid additive (e.g., powdered or liquid detergent) can mix with hot or cold water prior to being dispensed out of the extendable nozzle 202.

It should be appreciated that the amount of water or wash fluid added to wash tub 121 upon pressing user inputs 270 (FIG. 8) may vary depending on the application or wash cycle. Similarly, the amount of water delivered may be preset such that pressing user inputs 270 delivers the predetermined amount of water. Alternatively, valves 272 may be configured to remain open at all times when corresponding user inputs 270 are depressed. In this manner, a user may precisely control the amount of water added to wash tub 121. Additionally or alternatively, valves 272 may be configured to add or permit a different volume of wash fluid based on whether extendable nozzle 202 is in the retracted position and the extended position. For example, a first flow rate or volume of wash fluid may be permitted to flow to extendable nozzle 202 from valves 272 in response to extendable nozzle 202 being in the retracted position. A second flow rate or volume of wash fluid that is distinct from the first flow rate or volume may be permitted to flow to extendable nozzle 202 from valves 272 in response to extendable nozzle 202 being in the extended position. Optionally, the second flow rate or volume may be less than the first flow rate or volume.

Advantageously, operation of nozzle assembly 200 may automatically (e.g., without further user input) vary based on the position (e.g., retracted position or extended position) of extendable nozzle 202.

Turning now to FIGS. 9 through 12, various additional or alternative embodiments of a portion of nozzle assembly 200, including extendable nozzle 202 are illustrated. It is understood that nozzle assembly 200 may be provided as or in place of nozzle assembly 200 described above with respect to FIGS. 2 through 8. Moreover, except as otherwise indicated or in conflict, the below described embodiments may share one or more features.

As an example, referring generally to the embodiments of FIGS. 9 through 12, some embodiments include a wireless communications module 274 mounted to extendable nozzle 202. In particular, wireless communications module 274 may be fixed on top of or embedded within extendable nozzle 202. When assembled, wireless communications module 274 may be, for instance, electrically coupled to user inputs 270 (FIG. 8) and configured to wirelessly communicate with controller 108. For example, a matched communications module 276 may be provided with controller 108 (e.g., as an onboard component of controller 108 or as a separate, off board component) on control panel 110. Based on user engagement (e.g., actuation) of user inputs 270, wireless communications module 274 may transmit one or more signals to controller 108 (e.g., at matched communications module 276) to direct activation of one or more valves (e.g., valves 272—FIGS. 3 and 4) and the flow of wash fluid therefrom. In some embodiments, wireless communications module 274 is an infrared (IR) communications module configured to transmit or receive infrared light signals to/from controller 108. In additional or alternative embodiments, wireless communications module 274 is a radio frequency (RF) communications module configured to transmit or receive RF signals to/from controller across a preset communications band (e.g., Wi-Fi, Bluetooth®, ZigBee®, etc.). Moreover, further embodiments may be provided as any suitable component for wireless communication with controller 108.

In some embodiments, a nozzle battery 278 is mounted to extendable nozzle 202 (e.g., enclosed therein) in order to power a portion of extendable nozzle 202 (e.g., by providing a direct electrical current from nozzle battery 278). For instance, nozzle battery 278 may be electrically coupled to wireless communications module 274 and power operation thereof. Generally, nozzle battery 278 is provided as a direct current power source and, in specific embodiments, is a rechargeable battery formed of, for instance, lithium-ion, nickel-cadmium (NiCd), nickel-metal hydride (NiMH), etc. In some such embodiments, a battery charger 280 is provided (e.g., within housing 208 or within extendable nozzle 202) to selectively recharge nozzle battery 278 when operably coupled therewith.

Advantageously, the nozzle assembly 200 of the present disclosure may permit communication between extendable nozzle 202 and controller 108 without requiring multiple wires or conduits to be organized through cabinet 102. Such configurations may permit greater freedom of movement for extendable nozzle 202 and mounting thereof. Moreover, such configurations advantageously limit the potential for any electrical elements to become accidentally exposed to water or wash fluid in or near wash tub 121 (FIGS. 3 and 4).

Figure 9:
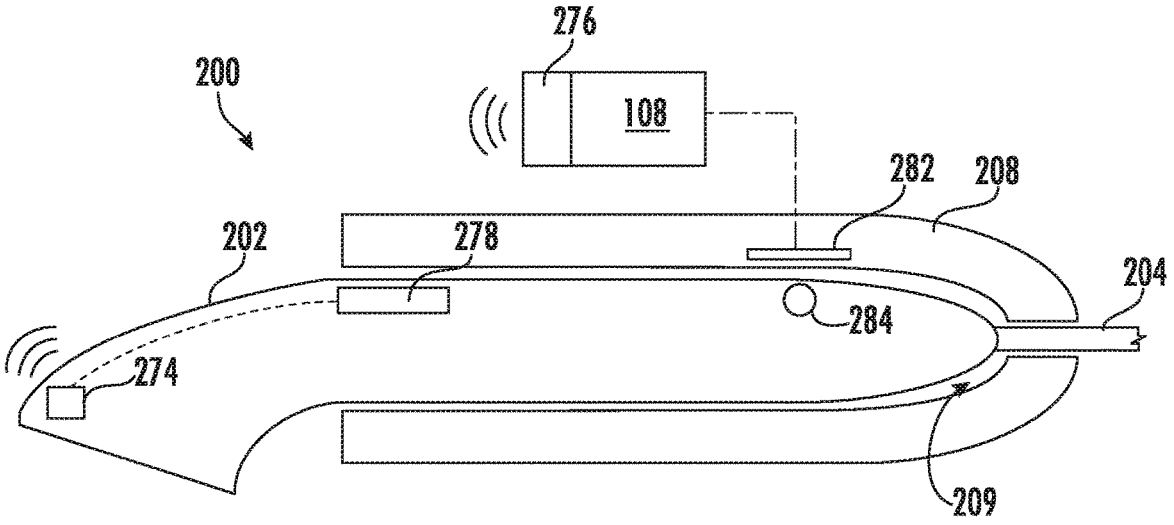
FIG. 9 provides a schematic side, cross-sectional view of a portion of a nozzle assembly shown in a retracted position according to an exemplary embodiment of the present disclosure.

Turning in particular to FIG. 9, some embodiments of nozzle assembly 200 include a positioning switch 282 to detect when extendable nozzle 202 is the retracted position or the extended position. In particular, positioning switch 282 may engage with extendable nozzle 202 in the retracted position (e.g., when extendable nozzle 202 is fully received within receiving chamber 209, as shown in FIG. 9). When extendable nozzle 202 is in a non-retracted position (e.g., the extended position), positioning switch 282 may be disengaged with extendable nozzle 202.

In some embodiments, positioning switch 282 is operably coupled (e.g., electrically coupled or wirelessly coupled) to controller 108. Positioning switch 282 may thus be configured to transmit or receive a position signal to controller 108 based on whether positioning switch 282 is engaged (i.e., whether extendable nozzle 202 is in the retracted position). As shown, positioning switch 282 may be mounted to nozzle housing 208 to detect when extendable nozzle 202 is fully received within receiving chamber 209. In some such embodiments, positioning switch 282 includes a magnetic proximity switch (e.g., reed switch, Hall Effect sensor, etc.). A location magnet 284 may be mounted or fixed to extendable nozzle 202. In turn, the location magnet 284 moves between the retracted and extended positions with extendable nozzle 202. In the retracted position, the location magnet 284 may be aligned with positioning switch 282 (e.g., radially aligned about the receiving chamber 209), such that the positioning switch 282 is engaged in magnetic communication with location magnet 284. Alternatively, any other suitable sensors or methods of detecting the position of extendable nozzle 202 may be used. For example, motion sensors, camera systems, or simple mechanical contact switches may be used according to alternative embodiments.

Figure 10:
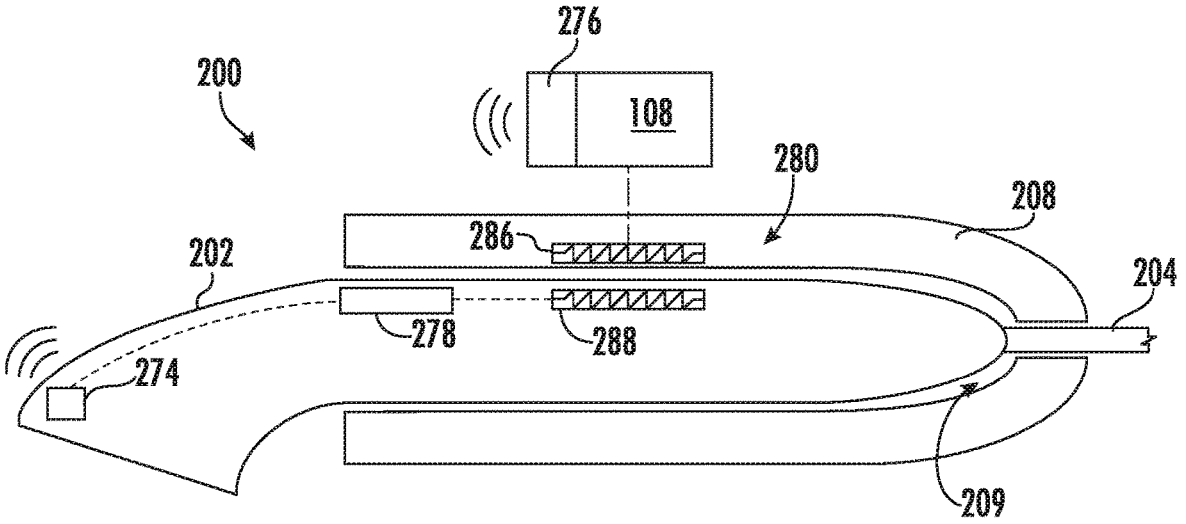
FIG. 10 provides a schematic side, cross-sectional view of a portion of a nozzle assembly shown in a retracted position according to a further exemplary embodiment of the present disclosure.

Turning in particular to FIG. 10, in some embodiments, battery charger 280 may be provided as a pair of matched induction coils 286, 288. A first induction coil 288 may be fixed mounted or fixed to extendable nozzle 202 and, thereby, moves between the retracted and extended positions with extendable nozzle 202. A second induction coil 286 may be fixed to nozzle housing 208. As illustrated, second induction coil 286 may be operably coupled to controller 108. In turn, controller 108 may initiate an electromagnetic field to be transmitted from second induction coil 286, which may then be received by the first induction coil 288 (i.e., when inductively coupled thereto). In the retracted position, the matched induction coils 286, 288 may be aligned (e.g., radially aligned about the receiving chamber 209), such that the second induction coil 286 is inductively coupled to first induction coil 288. Optionally, controller 108 may be further configured to detect inductive coupling between the pair of matched induction coils 286, 288 and, in response, determine extendable nozzle 202 is in the retracted position. Similarly, controller 108 may determine that extendable nozzle 202 is not in the retracted position (e.g., in the extended position) in response to a failure to detect inductive coupling between matched induction coils 286, 288.

Figure 11:
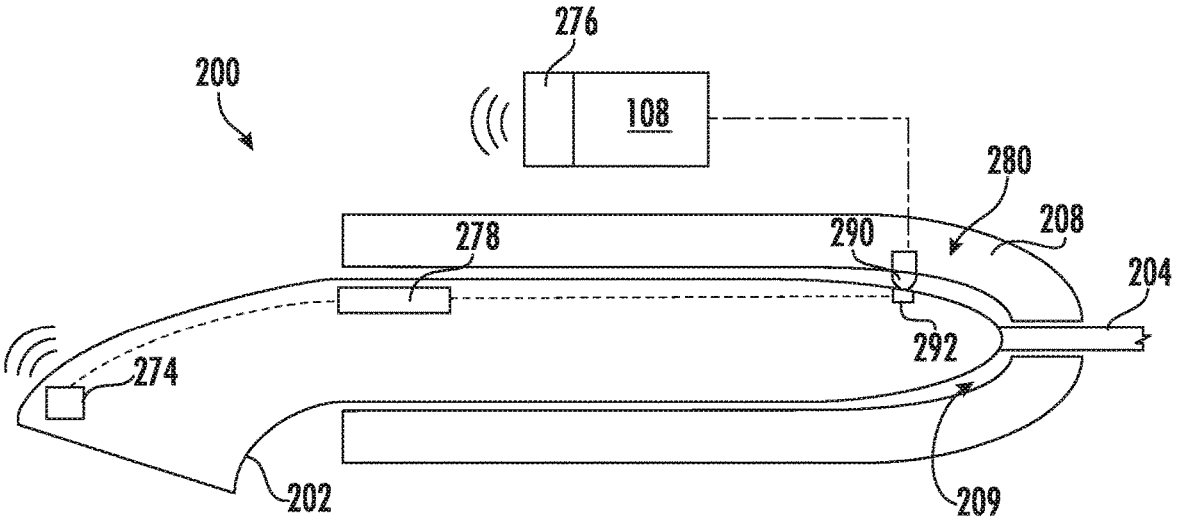
FIG. 11 provides a schematic side, cross-sectional view of a portion of a nozzle assembly shown in a retracted position according to another exemplary embodiment of the present disclosure.

Turning in particular to FIG. 11, in some embodiments, battery charger 280 may be provided as a pair of matched voltage contacts 290, 292. A first voltage contact 292 may be fixed mounted or fixed to extendable nozzle 202 and, thereby, moves between the retracted and extended positions with extendable nozzle 202. A second voltage contact 290 may be fixed to nozzle housing 208 and extend into receiving chamber 209. As illustrated, voltage contact may be operably coupled to controller 108. In turn, controller 108 may initiate an electrical current to be transmitted from second voltage contact 290, which may then be received by the first voltage contact 292 (i.e., when voltage contacts 290, 292 are in direct contact with each other). In the retracted position, the matched voltage contacts 290, 292 may be aligned (e.g., radially and angularly aligned about the receiving chamber 209), such that the voltage contact directly contacts first voltage contact 292. Optionally, controller 108 may be further configured to detect contact between the pair of matched voltage contacts 290, 292 and, in response, determine extendable nozzle 202 is in the retracted position. Similarly, controller 108 may determine that extendable nozzle 202 is not in the retracted position (e.g., in the extended position) in response to a failure to detect direct contact between matched voltage contacts 290, 292.

Figure 12:
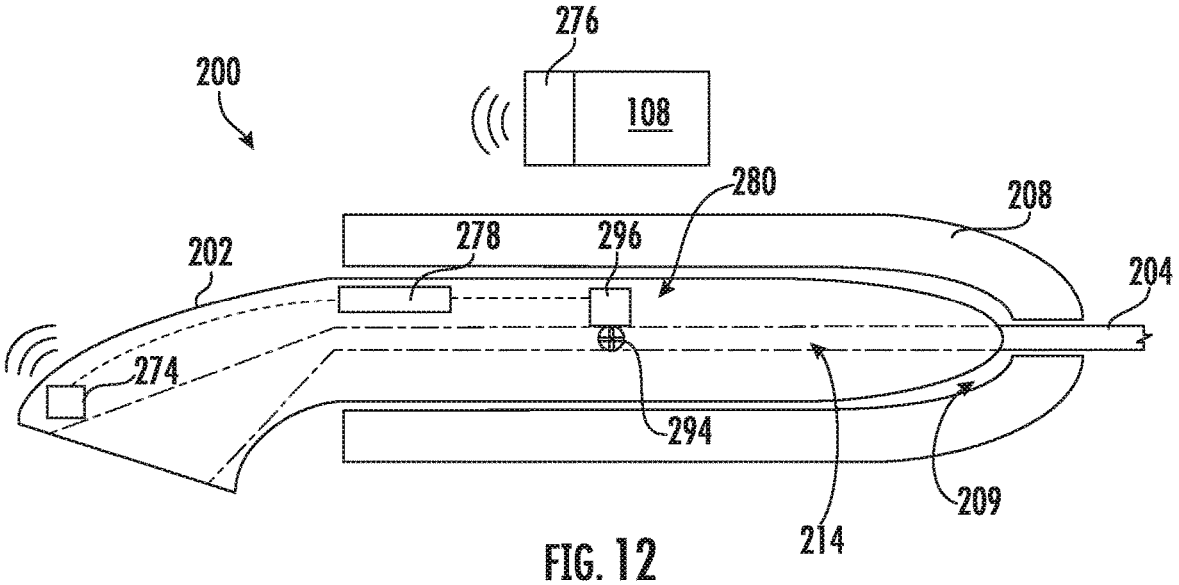
FIG. 12 provides a schematic side, cross-sectional view of a portion of a nozzle assembly shown in a retracted position according to yet another exemplary embodiment of the present disclosure.

Turning in particular to FIG. 12, battery charger 280 may include a direct current (DC) turbine 294 mounted within extendable nozzle 202. In particular, DC turbine 294 is mounted along a flow path 214 of wash fluid defined through extendable nozzle 202. Wash fluid flowing through extendable nozzle 202 may cause DC turbine 294 to rotate and, thereby, generate a direct electrical current at a DC circuit 296 electrically coupled to DC turbine 294. From DC circuit 296, the direct electrical current may be supplied to nozzle battery 278 and, thus, charge nozzle battery 278 as wash fluid passes through the flow path 214 and from extendable nozzle 202.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:
a cabinet;
a tub positioned within the cabinet;
a wash basket rotatably mounted within the tub, the wash basket defining a wash chamber for receiving articles for washing;
a nozzle assembly mounted within the cabinet and configured to provide wash fluid to the tub, the nozzle assembly comprising
a nozzle housing defining a receiving chamber within the cabinet,
an extendable nozzle movable between a retracted position within the receiving chamber and an extended position outside of the receiving chamber, and
a wireless communications module mounted to the extendable nozzle; and
a controller attached to the cabinet and wirelessly coupled to the nozzle assembly,
wherein the nozzle assembly further comprises a positioning switch mounted to the nozzle housing, the positioning switch being engaged with the extendable nozzle in the retracted position and disengaged with the extendable nozzle in the extended position, and wherein the controller is operably coupled to the nozzle assembly at the positioning switch to determine a position of the extendable nozzle.

2. The washing machine appliance of claim 1, wherein the wireless communications module comprises an infrared communications module.

3. The washing machine appliance of claim 1, wherein the wireless communications module comprises a radio frequency (RF) communications module.

4. The washing machine appliance of claim 1, wherein the positioning switch comprises a magnetic proximity switch, wherein a location magnet is fixed to the extendable nozzle, and wherein the magnetic proximity switch is in magnetic communication with the location magnet in the retracted position.

5. The washing machine appliance of claim 1, wherein the nozzle assembly further comprises a nozzle battery and a battery charger, wherein the nozzle battery is mounted to the extendable nozzle to provide a direct electrical current thereto, and wherein the battery charger is operably coupled to the nozzle battery to selectively recharge the nozzle battery.

6. The washing machine appliance of claim 5, wherein the battery charger comprises a direct current turbine mounted along a flow path of the wash fluid to generate an electrical current in response to wash fluid flow.

7. The washing machine appliance of claim 5, wherein the battery charger comprises a first voltage contact and a second voltage contact, wherein the first voltage contact is fixed to the extendable nozzle, and wherein the second voltage contact is fixed within the receiving chamber.

8. The washing machine appliance of claim 5, wherein the battery charger comprises a first voltage induction coil and a second induction coil, wherein the first induction coil is fixed to the extendable nozzle, and wherein the second induction coil is fixed to the nozzle housing to communicate with the first induction coil in the retracted position.

9. A washing machine appliance comprising:
a cabinet;
a tub positioned within the cabinet;
a wash basket rotatably mounted within the tub, the wash basket defining a wash chamber for receiving articles for washing;
a nozzle assembly mounted within the cabinet and configured to provide wash fluid to the tub, the nozzle assembly comprising
a nozzle housing defining a receiving chamber within the cabinet,
an extendable nozzle movable between a retracted position within the receiving chamber and an extended position outside of the receiving chamber,
a wireless communications module mounted to the extendable nozzle,
a nozzle battery mounted to the extendable nozzle to provide a direct electrical current thereto, and
a battery charger operably coupled to the nozzle battery to selectively recharge the nozzle battery; and
a controller attached to the cabinet and wirelessly coupled to the nozzle assembly,
wherein the battery charger comprises a first voltage contact and a second voltage contact, wherein the first voltage contact is fixed to the extendable nozzle, and wherein the second voltage contact is fixed within the receiving chamber.

10. The washing machine appliance of claim 9, wherein the wireless communications module comprises an infrared communications module.

11. The washing machine appliance of claim 9, wherein the wireless communications module comprises a radio frequency (RF) communications module.

12. The washing machine appliance of claim 9, wherein the nozzle assembly further comprises a positioning switch mounted to the nozzle housing, the positioning switch being engaged with the extendable nozzle in the retracted position and disengaged with the extendable nozzle in the extended position, wherein the controller is operably coupled to the nozzle assembly at the positioning switch to determine a position of the extendable nozzle, wherein the positioning switch comprises a magnetic proximity switch, wherein a location magnet is fixed to the extendable nozzle, and wherein the magnetic proximity switch is in magnetic communication with the location magnet in the retracted position.

13. A washing machine appliance comprising:
a cabinet;

a tub positioned within the cabinet;

a wash basket rotatably mounted within the tub, the wash basket defining a wash chamber for receiving articles for washing;

a nozzle assembly mounted within the cabinet and configured to provide wash fluid to the tub, the nozzle assembly comprising a nozzle housing defining a receiving chamber within the cabinet, an extendable nozzle movable between a retracted position within the receiving chamber and an extended position outside of the receiving chamber, a wireless communications module mounted to the extendable nozzle, a nozzle battery mounted to the extendable nozzle to provide a direct electrical current thereto, and a battery charger operably coupled to the nozzle battery to selectively recharge the nozzle battery; and a controller attached to the cabinet and wirelessly coupled to the nozzle assembly, wherein the battery charger comprises a first voltage induction coil and a second induction coil, wherein the first induction coil is fixed to the extendable nozzle, and wherein the second induction coil is fixed to the nozzle housing to communicate with the first induction coil in the retracted position.

14. The washing machine appliance of claim 13, wherein the wireless communications module comprises an infrared communications module.

15. The washing machine appliance of claim 13, wherein the wireless communications module comprises a radio frequency (RF) communications module.

16. The washing machine appliance of claim 13, wherein the nozzle assembly further comprises a positioning switch mounted to the nozzle housing, the positioning switch being engaged with the extendable nozzle in the retracted position and disengaged with the extendable nozzle in the extended position, wherein the controller is operably coupled to the nozzle assembly at the positioning switch to determine a position of the extendable nozzle, wherein the positioning switch comprises a magnetic proximity switch, wherein a location magnet is fixed to the extendable nozzle, and wherein the magnetic proximity switch is in magnetic communication with the location magnet in the retracted position.

* * * * *